US006595764B1

(12) United States Patent
Volk

(10) Patent No.: US 6,595,764 B1
(45) Date of Patent: Jul. 22, 2003

(54) DRYWALL FINISHING TOOL

(76) Inventor: Mark Volk, 2648 E. Workman Ave., #443, West Covina, CA (US) 91791

( * ) Notice: Subject to any disclaimer, the term of this patent is extended or adjusted under 35 U.S.C. 154(b) by 0 days.

(21) Appl. No.: 09/542,242

(22) Filed: Apr. 3, 2000

Related U.S. Application Data

(63) Continuation-in-part of application No. 08/956,265, filed on Oct. 24, 1997, now abandoned.

(51) Int. Cl.[7] ..... B29C 67/00

(52) U.S. Cl. ..... 425/87; 425/458; 15/235.3; 15/235.7; 15/235.8

(58) Field of Search ..... 425/87, 458; 15/235.3, 15/235.4, 235.7, 235.8; 401/9, 203, 266

(56) References Cited

U.S. PATENT DOCUMENTS 2,804,767 A * 9/1957 Schoen ..... 401/9
2,889,699 A * 6/1959 Ames ..... 425/87
2,984,857 A * 5/1961 Ames ..... 425/87
3,811,783 A * 5/1974 Johnson ..... 401/9
4,116,604 A * 9/1978 Johnson et al. ..... 425/87
4,451,223 A * 5/1984 Mower et al. ..... 425/458
4,767,297 A * 8/1988 Mower et al. ..... 425/87
4,784,598 A * 11/1988 Kranz et al. ..... 425/458
4,919,604 A * 4/1990 Wilson ..... 425/458
5,143,264 A * 9/1992 MacMillan ..... 425/87
5,192,558 A * 3/1993 Sparrow et al. ..... 425/87
5,670,182 A * 9/1997 Mower ..... 425/87

* cited by examiner

*Primary Examiner*—Robert Davis
*Assistant Examiner*—Thu Khanh T. Nguyen
(74) *Attorney, Agent, or Firm*—Rutan & Tucker LLP; Bob Fish; David J. Zoeteway

(57) ABSTRACT

A corner finishing tool having a hard planar spreading member, a receiver portion, and a tensioning assembly. The spreading member has upper and lower surfaces, each surface having front, rear, left and right edges, wherein the spreading member can be flexed so as to move from an un-flexed state to a flexed state by moving the left and right edges upward and towards each other. The receiver portion is sized and dimensioned to receive a finishing compound dispenser and includes a through hole extending between the upper and lower surfaces of the spreading member. The tensioning assembly provide the capability of increasing and decreasing the amount of force required to flex the left and right edges towards each other.

14 Claims, 1 Drawing Sheet

DRYWALL FINISHING TOOL

This is a continuation-in-part of U.S. application Ser. No. 08/956,265, filed Oct. 24, 1997, now abandoned, incorporated herein by reference in its entirety.

FIELD OF THE INVENTION

The field of the invention is drywall finishing tools.

BACKGROUND OF THE INVENTION

Considerable resources have been invested over the years to develop methods and devices for finishing joints. The term "joint", as sometimes used herein, is used in the context of two surfaces which are directly in contact with each other, or which are connected by way of a joining surface. In either case the term joint is used to refer to portions of the two surfaces near where they are joined as well as any joining surface. "Finishing joints", as sometimes used herein, refers broadly to the process of adding a finishing compound, defined as any viscous substance, so as to form a joint or to modify a previously formed joint. If finishing compound is added to form a joint, the finishing compound is spread onto portions of two surfaces and the substance itself becomes the joining surface. If used to modify the joint, finishing compound is spread onto the joint so as to change some characteristic such as the appearance or durability of the joint.

The term, "joint angle" may be used sometimes hereinafter to describe the angle which is formed by the two joined surfaces, which includes any joining surface and into which the finishing compound is to be spread or applied.

A common example of joint finishing is the application of drywall compound to the corner of a room, the corner formed by placing two sheets of drywall in contact with each other so as to form a 90 degree angle. Any gaps between the sheets are often covered with finishing ("drywall") tape. Once the joint is formed from the drywall sheets and tape, drywall compound is spread onto the joint. Another example of joint finishing is the spreading of calking into the space between two tiles so that the calking forms a joining surface between the tiles.

Tools to aid in the dispensing and spreading of finishing compounds are known. As an example, U.S. Pat. No. 4,767,297 (the '297 patent) to Mower and Cezana (Aug. 30, 1988) describes a corner finishing tool having means to contain a supply of mastic, and generally perpendicular means for defining a corner. The tool of '297, however, will not work if applied to a joint having a joint angle which is significantly greater than 90 degrees. (90 degree joints are sometimes hereinafter referred to as "perpendicular joints".) Additionally, the tool always forms "squared off" joint rather than a "rounded" joint. (The term "non-perpendicular" joints is sometimes hereinafter used to refer to all joints which are not perpendicular, including "rounded" joints.) Squared off joints have the disadvantage that they form a visual line along the joint which makes it easy to visually determine how straight the joint is. As a result, extra time and effort is often spent trying to "straighten" the visual line.

The visual line problem can be eliminated by forming a "rounded" joint rather than a "squared off" joint, largely because a "rounded" joint eliminates the visual. Tools, such as those described in U.S. Pat. No. 4,919,604 to Wilson (Apr. 24, 1990) and U.S. Pat. No. 4,784,598 to Kranz et al (Nov. 15, 1988), can be used to product "rounded" joints. Another advantage of using a tool suitable to form "rounded" corners is that it is more likely to work in corners having a joint angle which is significantly greater than 90 degrees.

Previously known tools suitable for forming "rounded" corners do, however, suffer from a severe limitation in that they are not suitable for use with a finishing compound dispenser. Thus, the application and spreading of finishing compound cannot be done in a single pass. Instead, finishing compound must first be applied. Once that is done, one must switch between the application tool and the finishing tool, and then make a second pass along the joint. A related problem is that it is difficult to judge how much finishing compound to use. If all the finishing compound is applied before spreading begins, errors in the amount of compound applied become troublesome. If too little compound is applied, the process of application and spreading must be repeated. If too much compound is applied, the excess compound tends to get pushed into "piles" which require extra effort to remove. However, if the compound is applied on a continuous basis and is immediately being spread the problem is essentially solved because it is possible to adjust the amount of compound being applied before any lack or surplus becomes problematic.

Joints having joint angle which vary significantly from 90 degrees tend to be troublesome. The "squared off" tools often will not work if the joint angle is much greater or less than 90 degrees. Even if a "squared off" tool was hinged to allow it to deal with such angles, it would still have the problem of creating a visual line, and the greater the joint angle, the more difficult it is to keep that visual line straight. The "rounded" tools will often work with joint angles which are greater than 90 degrees, but, in addition to being incapable of both dispensing and spreading, are not suited for joint angles which are greater than 180 degrees.

Thus, there is a continuing need to improve tools and methods for finishing joints.

SUMMARY OF THE INVENTION

The present invention is directed to methods and devices for finishing non-perpendicular joints, including a corner finishing tool comprising a hard planar spreading member, a receiver portion, and a tensioning assembly. The spreading member has upper and lower surfaces, each surface having front, rear, left and right edges, wherein the spreading member can be flexed so as to move from an un-flexed state to a flexed state by moving the left and right edges upward and towards each other. The receiver portion is sized and dimensioned to receive a finishing compound dispenser and includes a through hole extending between the upper and lower surfaces of the spreading member. The tensioning assembly provide the capability of increasing and decreasing the amount of force required to flex the left and right edges towards each other.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
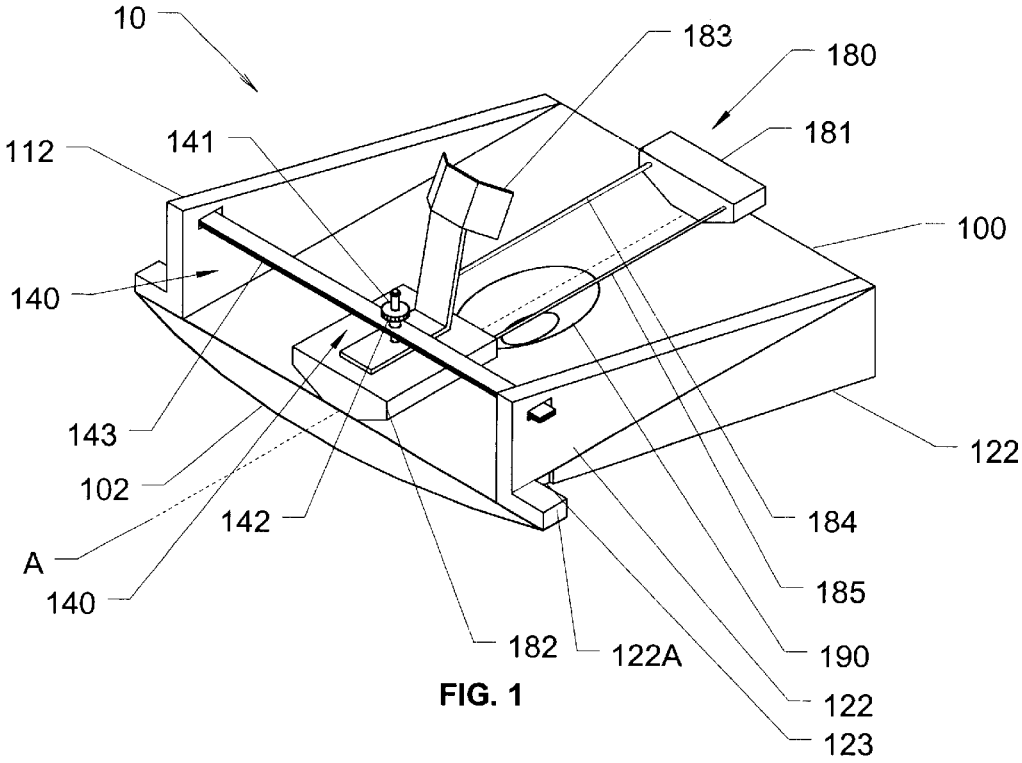
FIG. 1 is a left top perspective view of a finishing tool embodying the invention.
Figure 2:
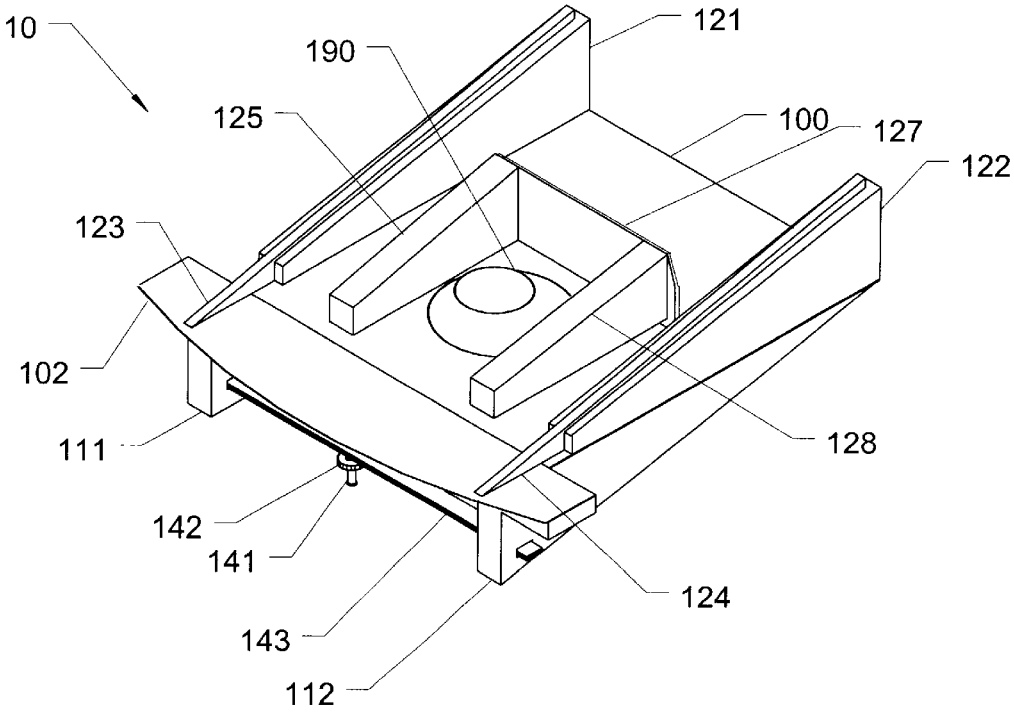
FIG. 2 is a right bottom perspective view of the tool of FIG. 1.

Referring first to FIGS. 1–2, a finishing tool 10 has a hard, flexible, non-hinged, planar spreading surface 100, wipe down blade 102, stiffening rails 111 and 112, guide rails 121 and 122, contact blades 123 and 124, dispenser support rails 125 and 128, catcher 127, tensioning assembly 140, receiving assembly 180, and receiving portion 190. Tensioning assembly 140 comprises threaded post 141, knurled nut 142, and flat tension springs 143. Receiving assembly 180 comprises heal 181, toe 182, brake 183, and retaining wires 184 and 185. Hard flexible surface is used herein to mean a surface which can change its form.

The hard, flexible spreading member 100 is preferred to comprise a thin, flexible, springy metal sheet wherein the surface of the sheet is resistant to indentation but the sheet can be flexed about axis A so as to move the sides left and right sides of the sheet upward and towards each other. Pressure applied to the contact blades 123 and 124, such as by pressing the tool into a joint, causes the surface to deform to a shape suitable for spreading finishing compound into the joint. However, spreading member 100 could be any material capable of flexing so as to allow its left and right edges to move upward and toward each other, and thus to partially conform to the shape of a joint.

Flexible spreading member 100 may be augmented by a hard flexible wipe down blade 102 coupled to the front edge of the spreading member, the wipe down blade 102 having a front edge that extends beyond the front edge of the spreading member. The thickness, shape, and makeup of the wipe down blade can be used to adjust the amount of tension required to flex spreading member 100, and to modify the shape of the finished joint.

The surface of the spreading member may advantageously be referred to as the lower surface of the spreading member, the opposite surface may advantageously be referred to as the upper surface, the edge to which wiper blade 102 is coupled the front edge, the opposite edge the back edge, and the left and right edges being the edges corresponding to a viewer's left and right hands when looking at the upper surface with the wiper blade up.

The spreading member can be viewed as having a length and a width, where the length is the dimension of the surface from the front edge to the back edge, i.e. along a line which would follow the joint if the tool were being used, and its width is the dimension of the surface from the left edge to the right edge.

In conforming to the joint angle, it is preferred that the spreading member deform along its width, but not its length, so as to form a curved shape for spreading finishing compound into the joint. The exact shape that the surface takes need not be a uniform curve, and might also be formed prior to the tool being used to apply finishing compound to the joint. Such pre-shaping might be the result of adjusting a shaping mechanism incorporated in the tool itself, or one which is external to the tool.

Whether shaped prior to application or during application, the spreading member might or might not be capable of returning to its original shape. However, it is preferred that the spreading member be capable of returning to its original shape. The surface itself might be plasticly deformable enough to cause it to return to its original shape, or a return mechanism such as a spring might be added to assist it in returning to its original shape.

The receiver portion 190 is sized and dimensioned to receive a finishing compound dispenser. As finishing compound dispensers will generally be sized and dimensioned differently from each other, different embodiments of the receiver portion 190 could be sized and dimensioned differently. Receiver portion 190 and receiver assembly 180 are optimized for use with a dispenser comprising a "ball joint" dispensing outlet. The "ball" is pushed between retaining wires 184 and 185 so that the retaining wires help prevent separation of the dispenser and tool 10. Brake 183 provides additional support to a dispenser when it is coupled to the tool 10, and help prevent the dispenser from rotating to far in the forward direction.

It is contemplated that the receiver portion be used to receive a handle instead of a finishing compound dispenser. When the receiver portion 190 is used to receive a handle, the finishing tool can be used to smooth down finishing tape prior to the application of a finishing compound. If the receiver portion is sized and dimensioned to receive a ball joint, using a handle with such a ball joint allows the tool to pivot around the joint.

Tensioning assembly 140 is capable of increasing and decreasing the amount of force required to flex the left and right edges towards each other. By raising or lowering knurled nut 142 on threaded post 141, the distance which flat springs 143 can travel along threaded post 141 is controlled. Once the spreading member 100 has been flexed sufficiently to cause springs 143 to run into knurled nut 142, further flexing requires that springs 143 be flexed as well and thus increases the amount of force required to flex spreading member 100. Springs 143 are preferably slidingly coupled to stiffening rails 121 and 122 positioned on the upper surface and along the left and right edges of the spreading member such that the springs 143 can slide through the stiffening rails until the springs 143 run into knurled nut 142. Springs 143 are each preferred to comprise a flat flexible piece of metal. It may be said that springs 143 bias the left and right edges of the spreading member away from each while the spreading member is in its flexed state.

Guide rails 111 and 112 provide a mechanism for preventing the front and rear/back edges of the spreading member 100 from flexing towards each other and for maintaining a minimum application angle between the spreading member 100 and a joint. Such guide rails could either be adjustable by way of adjusting mounting angle of the rails or by way of adjusting the position of the rails on the spreading member 100. Mechanisms other than guide rails could also be used.

In the preferred embodiment of FIGS. 1 and 2, a left guide rail 121 is positioned on the lower surface and along the left edge of the spreading member 100 and a right guide rail 122 is positioned on the lower surface and along the right edge of the spreading member, with the right and left rails being substantially parallel to each other when the spreading member is not in a flexed state. Guide rails 121 and 122 each comprise a contact blade 123 or 124, with each contact blade extending outward from its corresponding guide rail in a direction away from the bottom of the spreading member.

The preferred embodiment of FIGS. 1 and 2 also includes a left dispenser support rail 125 positioned between the through hole and the left guide rail and a right dispenser support rail 128 positioned between the through hole and the right guide rail. The dispenser support rails insure that the outlet of a dispenser is always sufficiently far from the joint so as to allow for proper flow of the finishing compound between the tool 10 and a joint. Moreover, a catcher plate 127 extends between the left and right dispenser support rails, the catcher plate being positioned between the through hole and the back edge of the spreading member. The catcher plate helps prevent finishing compound from falling to the ground/floor during use of the tool.

Thus, specific embodiments and applications of drywall finishing tools have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A corner finishing tool comprising:

a hard planar spreading member having upper and lower surfaces, each surface having front, rear, left and right edges, wherein the spreading member can be flexed so as to move from an un-flexed state to a flexed state by moving the left and right edges upward and towards each other;

a receiver portion sized and dimensioned to receive a finishing compound dispenser, the receiver portion comprising a through hole extending between the upper and lower surfaces of the spreading member;

a tensioning assembly capable of increasing and decreasing the amount of force required to flex the left and right edges towards each other.

2. The finishing tool of claim 1 further comprising a hard flexible wipe down blade coupled to the front edge of the spreading member, the wipe down blade having a front edge that extends beyond the front edge of the spreading member.

3. The finishing tool of claim 2 wherein the tensioning assembly biases the left and right edges of the spreading member away from each other while the spreading member is in its flexed state.

4. The finishing tool of claim 3 further comprising:

a left guide rail positioned on the lower surface and along the left edge of the spreading member;

a right guide rail positioned on the lower surface and along the right edge of the spreading member, the right and left rails being substantially parallel to each other when the spreading member is not in a flexed state;

the guide rails functioning to prevent the front and rear edges from being flexed towards each other.

5. The finishing tool of claim 4 wherein the guide rails each comprise a contact blade each contact blade extending outward from its corresponding guide rail in a direction away from the bottom of the spreading member, wherein the guide rails maintain a fixed angle between each contact blade and the lower surface of the spreading member.

6. The finishing tool of claim 5 further comprising a left dispenser support rail positioned between the through hole and the left guide rail and a right dispenser support rail positioned between the through hole and the right guide rail, wherein the left and right dispenser support rails are adapted to allow for proper flow of finishing compound between the tool and a joint.

7. The finishing tool of claim 6 wherein a catcher plate extends between the left and right dispenser support rails, the catcher plate being positioned between the through hole and the back edge of the spreading member.

8. The finishing tool of claim 7 further comprising:

a left stiffening rail positioned on the upper surface and along the left edge of the spreading member;

a right stiffening rail positioned on the upper surface and along the right edge of the spreading member, the right and left stiffening rails being substantially parallel to each other when the spreading member is in not in a flexed state;

the stiffening rails functioning coupled to the tensioning assembly.

9. The finishing tool of claim 8 wherein the tensioning assembly comprises flat, flexible member extending between the stiffening rails, the flexible member providing the bias between the left and right edges of the spreading member while the spreading member is in its flexed state.

10. The finishing tool of claim 9 wherein the receiving assembly comprises a brake, a heal member, a toe member, and two retaining wires wherein the retaining wires are anchored to the spreading member via the heal and toe members; the heal and toe members are shaped and mounted to the spreading member in a manner which facilitates flexing the spreading member; and the brake is sized and dimensioned to support a finishing compound dispenser being received by the receiving portion.

11. The finishing tool of claim 10 wherein the wipe down blade extends beyond the left and right edges of the spreading member.

12. The finishing tool of claim 11 wherein the wipe down blade is divided into a left wing, a right wing, and a center portion by the contact blades, the center portion being flexible and the left and right wings being inflexible.

13. The finishing tool of claim 12 wherein the guide rails and stiffening rails are substantially coplanar regardless of whether the spreading member is in a flex or un-flexed state.

14. The finishing tool of claim 13 wherein flexing the spreading member changes the orientation of the guide rails and support rails relative to each other such that they are less parallel to each other than they are when the spreading member is not being flexed.

* * * * *